US008188928B2

(12) United States Patent
Lin et al.

(10) Patent No.: US 8,188,928 B2
(45) Date of Patent: May 29, 2012

(54) ANTENNA MODULE AND DESIGN METHOD THEREOF

(75) Inventors: Yi-Cheng Lin, Taipei (TW); Kuo-Fong Hung, Taipei (TW); Bing-Syun Li, Taipei (TW)

(73) Assignee: National Taiwan University, Taipei (TW)

( * ) Notice: Subject to any disclaimer, the term of this patent is extended or adjusted under 35 U.S.C. 154(b) by 464 days.

(21) Appl. No.: 12/492,009

(22) Filed: Jun. 25, 2009

(65) Prior Publication Data

US 2010/0149060 A1 Jun. 17, 2010

(30) Foreign Application Priority Data

Dec. 12, 2008 (TW) ..... 97148494 A

(51) Int. Cl.
*H01Q 1/38* (2006.01)

(52) U.S. Cl. ..... 343/700 MS; 343/909; 343/767

(58) Field of Classification Search ..... 343/700 MS, 343/702, 846, 909, 767
See application file for complete search history.

(56) References Cited

U.S. PATENT DOCUMENTS 6,262,495 B1 * 7/2001 Yablonovitch et al. ..... 307/101
6,433,756 B1 * 8/2002 Sievenpiper et al. ..... 343/909
6,657,592 B2 * 12/2003 Dening et al. ..... 343/700 MS
6,906,674 B2 * 6/2005 McKinzie et al. ..... 343/767
7,612,676 B2 * 11/2009 Yuen et al. ..... 340/572.7

* cited by examiner

*Primary Examiner* — Hoanganh Le

(57) ABSTRACT

An antenna module is provided. The antenna module includes an antenna and an EBG element. The EBG element includes an EBG ground layer, a plurality of reflective units and a plurality of connection posts. The reflective units are arranged in a matrix, a gap is formed between the nearby reflective units, and the reflective units are corresponding to the antenna. Each connection post connects the reflective unit to the EBG ground layer.

9 Claims, 5 Drawing Sheets

1

ANTENNA MODULE AND DESIGN METHOD THEREOF

CROSS REFERENCE TO RELATED APPLICATIONS

This Application claims priority of Taiwan Patent Application No. 097148494, filed on Dec. 12, 2008, the entirety of which is incorporated by reference herein.

BACKGROUND OF THE INVENTION

1. Field of the Invention

The present invention relates to an antenna module, and in particular relates to an antenna module providing single directional radiation.

2. Description of the Related Art

Circular polarization antennas have two-way radiation properties. In conventional antenna modules, a reflector is disposed under a circular polarization antenna (slot antenna) with a distance of a quarter wave length, and an inphase mapping current is generated below the circular polarization antenna to provide single directional radiation. However, dimension of the conventional antenna module is limited by the position of the reflector (the quarter wave length), so the size thereof is large, and the antenna module cannot be utilized in common portable electronic devices.

BRIEF SUMMARY OF THE INVENTION

A detailed description is given in the following embodiments with reference to the accompanying drawings.

An antenna module is provided. The antenna module includes an antenna and an electromagnetic band gap (EBG) element. The EBG element includes an EBG ground layer, a plurality of reflective units and a plurality of connection posts. The reflective units are arranged in a matrix, a gap is formed between the nearby reflective units, and the reflective units are corresponding to the antenna. Each connection post connects the reflective unit to the EBG ground layer.

Utilizing the antenna module of the embodiment of the invention, the EBG element provides single directional radiation property. The EBG element is directly connected to the slot antenna with adhesive material, rather than kept at a quarter wavelength from the slot antenna distance. The volume of the antenna module is reduced. Thus, the antenna module of the embodiment can be utilized in various portable electronic devices.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
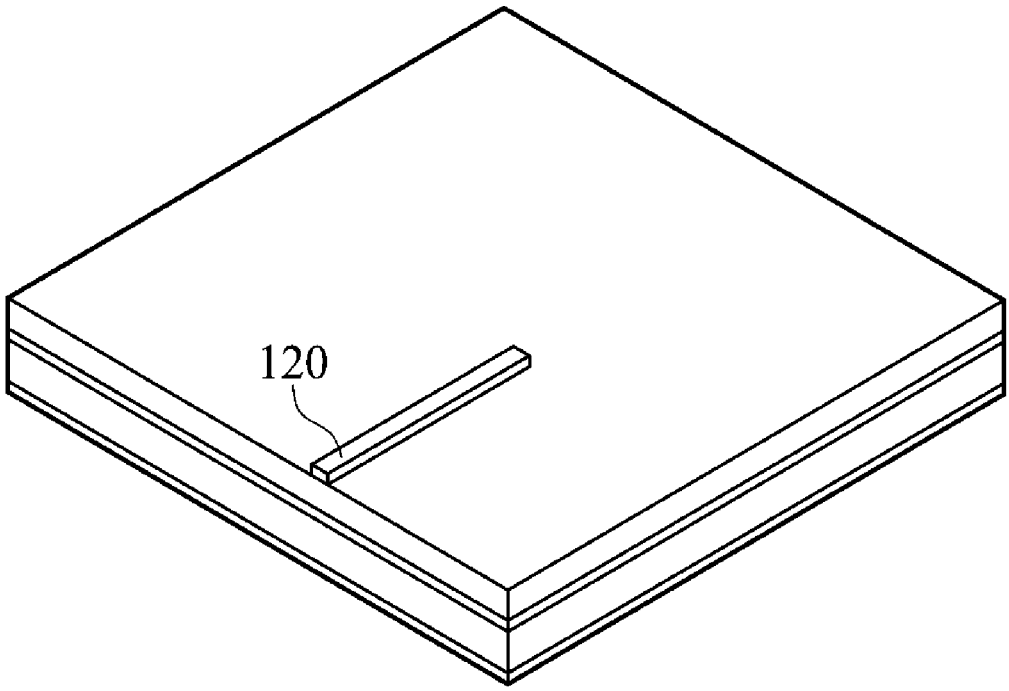
FIG. 1*a* is an assembly view of an antenna module 1 of an embodiment of the invention.
Figure 1B:
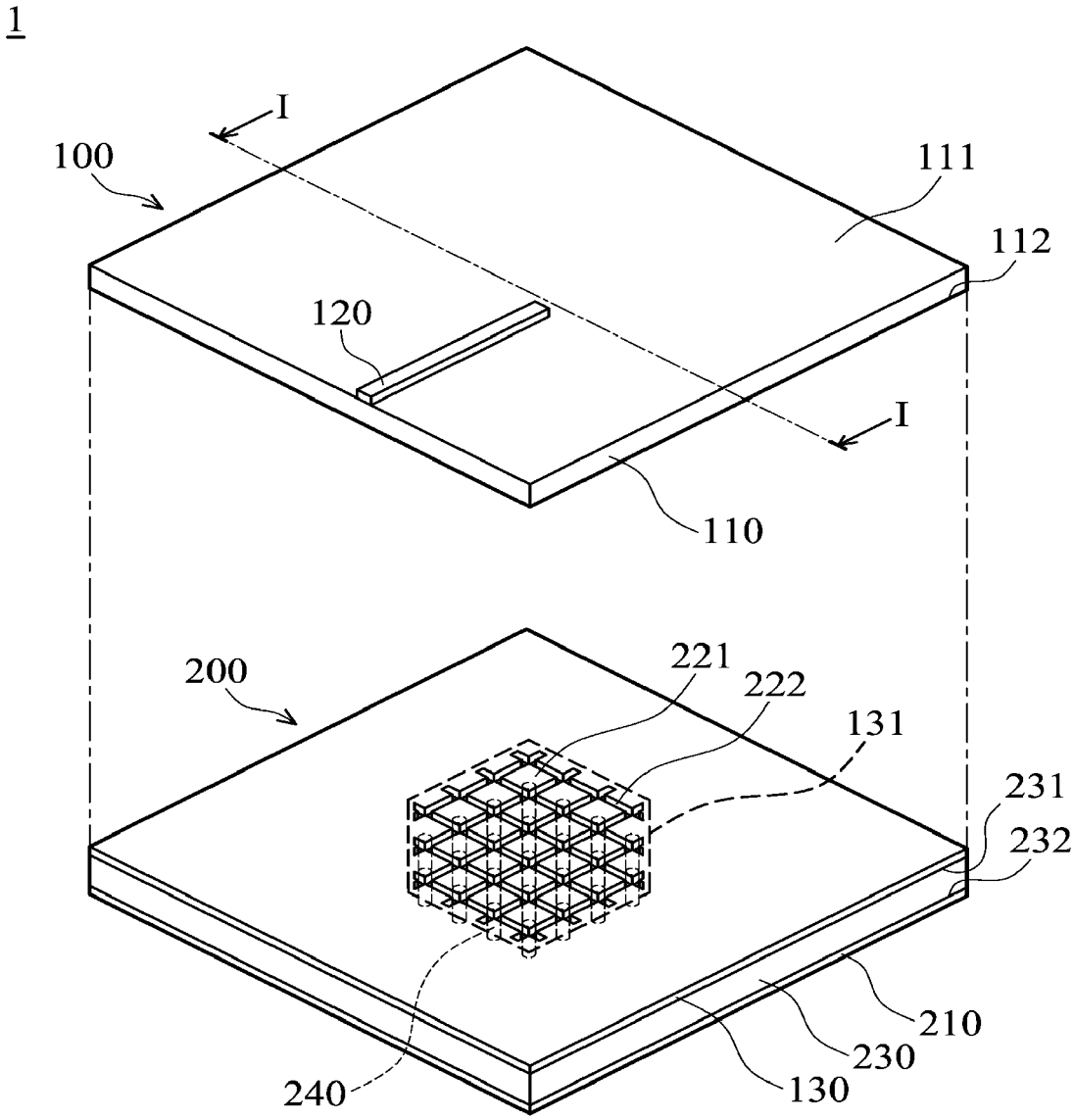
FIG. 1*b* is an exploded view of the antenna module 1 of the embodiment of the invention.

FIG. 1*a* is an assembly view of an antenna module 1 of an embodiment of the invention. FIG. 1*b* is an exploded view of the antenna module 1 of the embodiment of the invention. With reference to FIG. 1*a*, the antenna module 1 comprises a slot antenna 100 and an electromagnetic band gap (EBG) element 200. The slot antenna 100 and the EBG element 200 are connected by adhesive material.

With reference to FIG. 1*b*, the slot antenna 100 comprises an antenna substrate 110, a feed conductor 120 and an antenna ground layer 130. The antenna substrate 110 comprises a first surface 111 and a second surface 112. The feed conductor 120 is disposed on the first surface 111.

The EBG element 200 corresponding to the slot antenna 100, comprise an EBG ground layer 210, a plurality of reflective units 221, and EBG substrate 230 and a plurality of connection posts 240. The reflective units 221 are arranged in a matrix on the antenna ground layer 130, and define a slot area 131 on the antenna ground layer 130. The feed conductor 120 extends corresponding to the slot area 131. A gap 222 is formed between the nearby reflective units 221, and each reflective unit 221 is connected to the ground layer 210 via the connection post 240.

Figure 2:
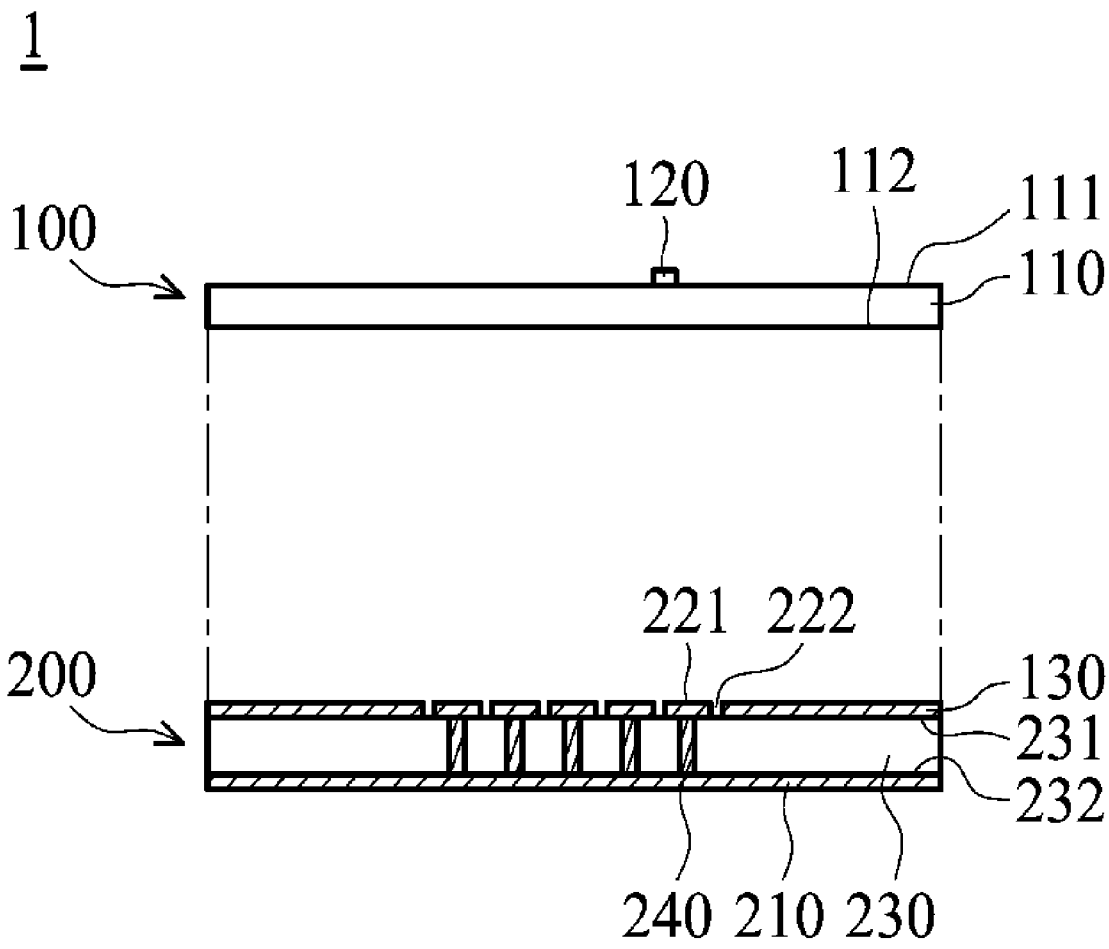
FIG. 2 is a sectional view along direction I-I of FIG. 1*b;*

FIG. 2 is a sectional view along direction I-I of FIG. 1*b*, wherein the EBG substrate 230 comprises a third surface 231 and a fourth surface 232. The reflective units 221 and the antenna ground layer 130 are disposed on the third surface 231. The EBG ground layer 210 is disposed on the fourth surface 232. The connection posts 240 pass the EBG substrate 230, and connect the reflective units 221 to the EBG ground layer 210.

The third surface 231 faces the second surface 112.

In the embodiment of the invention, the slot antenna 100 is a circular polarization antenna.

In the embodiment of the invention, the EBG element 200 provides single directional radiation property for the slot antenna with an operation principle similar to the Perfect Magnetic Conductor (PMC) principle. Thus, the EBG element is directly connected to the slot antenna with adhesive material, rather than kept at a quarter wavelength from the slot antenna distance. In the embodiment of the invention, the EBG element 220 has a reflection phase, and the reflection phase is −90° to provide improved matching effect.

In the embodiment of the invention, the reflective units define the slot area on the antenna ground layer. However, the invention is not limited thereto. A common slot antenna can also be combined with the EBG element of the invention. For example, in one embodiment, an antenna ground layer has a slot, reflective units of an EBG element are corresponding to the slot, and the reflective units and the antenna ground layer are located on a same plane.

Figure 3:
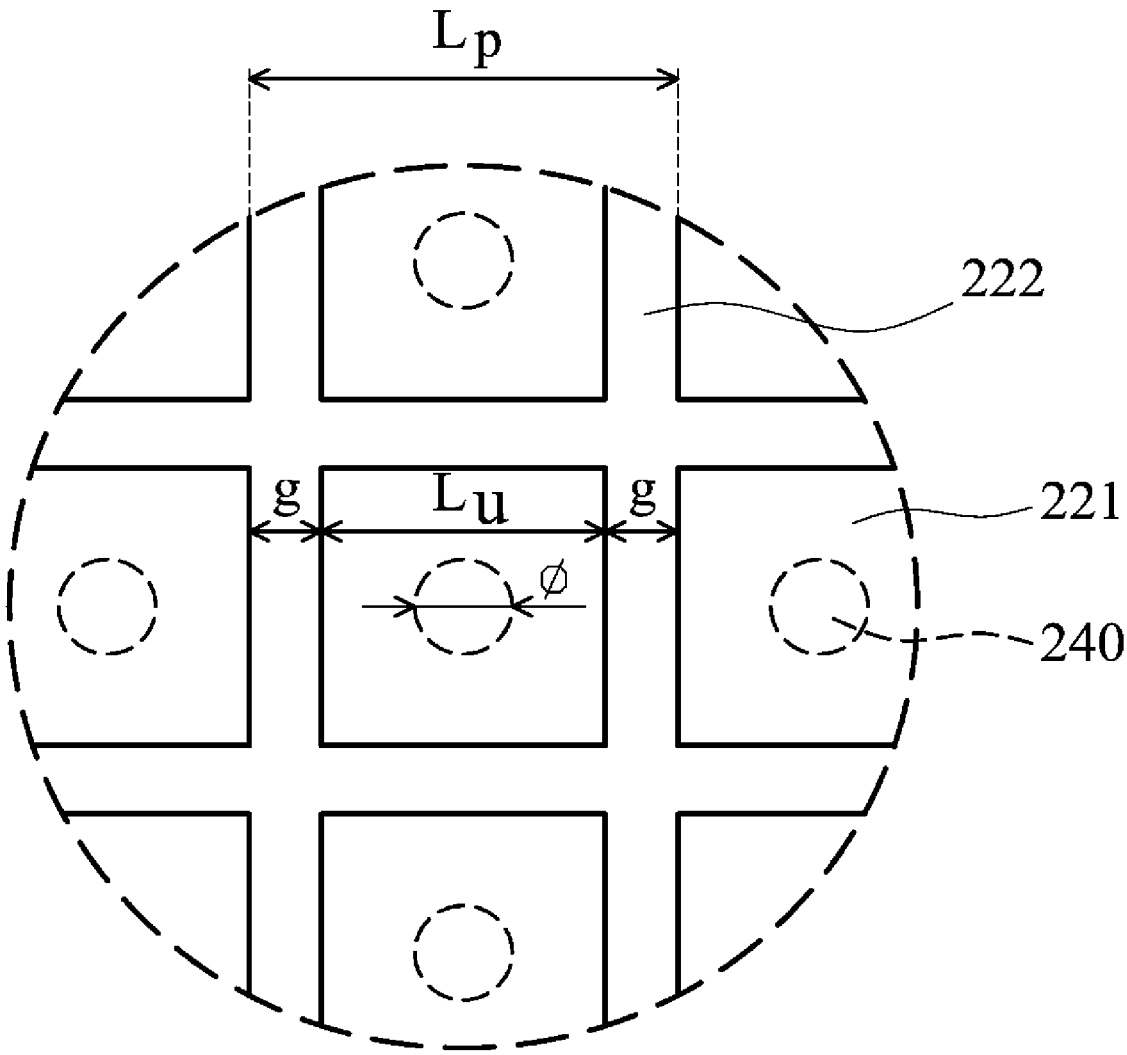
FIG. 3 shows a detailed structure of the reflective unit 221.

FIG. 3 shows a detailed structure of the reflective unit 221. The reflective unit 211 is square, which can be formed on the third surface 231 by a printing or photolithography process. The connection post 240 is cylinder, and disposed on the center of the reflective unit 221. The reflective unit 221 has a unit length $L_u$, the gap 222 has a gap width g, a cycle length $L_p$ is equal to two times the gap width plus the unit length $L_u$. The cycle length $L_p$ can be adjusted to modify the reflection phase of the EBG element 200. An operation frequency of the EBG element 200 can be modified by adjusting the unit length $L_u$ of the reflective unit 221 and the gap width g of the gap 222. The connection post 240 has a diameter $\phi$, and the operation frequency and the operation bandwidth of the EBG element

200 can be modified by changing the diameter ϕ of the connection post 240. Additionally, the operation frequency of the EBG element 200 can also be modified by changing the thickness and material of the EBG substrate 230.

In the embodiment of the invention, the cycle length $L_p$ is 2.4 mm, the unit length $L_u$ is 2 mm, the gap width g is 0.2 mm and the diameter ϕ is 0.5 mm. The thickness h of the EBG substrate 230 is 2.4 mm, and a dielectric coefficient of the EBG substrate 230 is 4.4.

Figure 4:
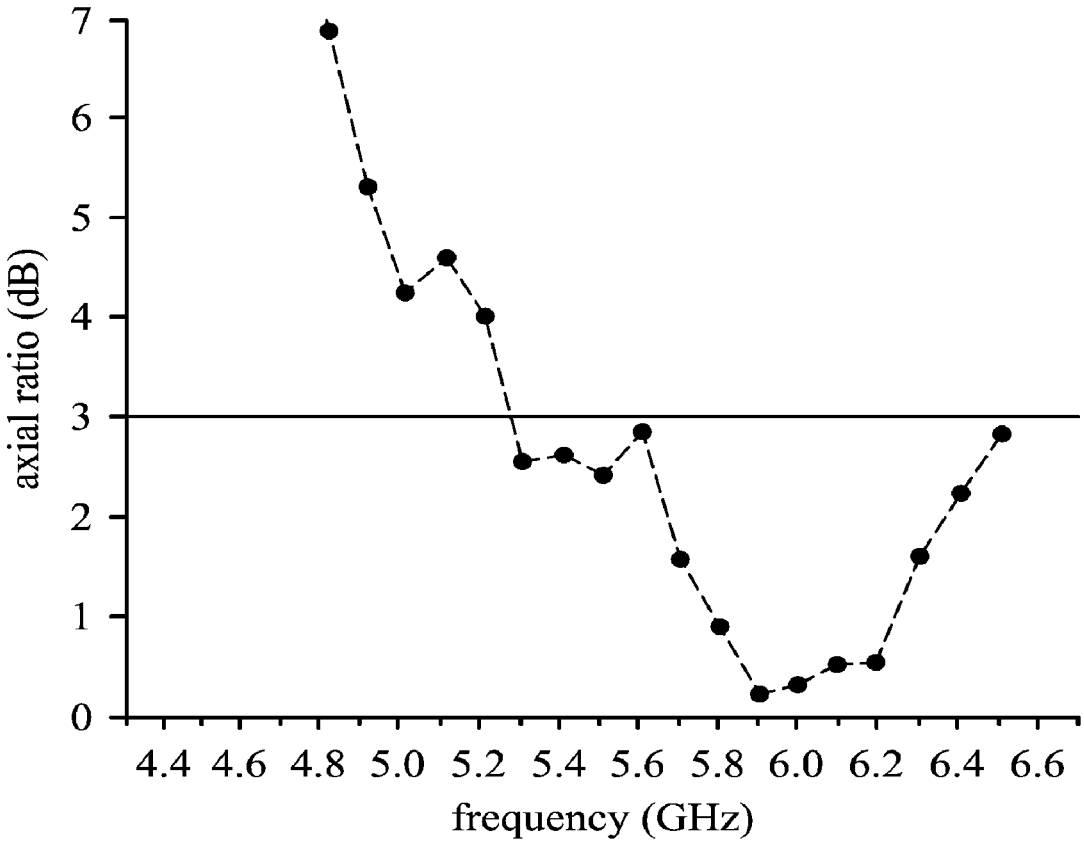
FIG. 4 shows an ellipse major-minor axial ratio frequency of the embodiment of the invention.

FIG. 4 shows an ellipse major-minor axial ratio frequency of the embodiment of the invention, wherein the axial ratio of the antenna module 1 of the embodiment can reach 20%. Therefore, the embodiment of the invention provides improved transmission.

Utilizing the antenna module of the embodiment of the invention, the EBG element provides single directional radiation property. The EBG element is directly connected to the slot antenna with adhesive material, rather than kept at a quarter wavelength from the slot antenna distance. The volume of the antenna module is reduced. Thus, the antenna module of the embodiment can be utilized in various portable electronic devices.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna module, comprising:

an antenna substrate, comprising a first surface and a second surface;

a feed conductor, disposed on the first surface;

an antenna ground layer, corresponding to the second surface, wherein an aperture is formed on the antenna ground layer, and the feed conductor feeds a signal to the aperture;

a plurality of reflective units, formed on the antenna ground layer, wherein the reflective units are arranged in a matrix, a gap is formed between the nearby reflective units, and the reflective units are located in the aperture of the antenna ground layer;

an EBG ground layer; and a plurality of connection posts, wherein each connection post connects the reflective unit to the EBG ground layer.

2. The antenna module as claimed in claim 1, wherein the antenna module is a circular polarization antenna module.

3. The antenna module as claimed in claim 1, wherein each reflective unit has a reflection phase, and the reflection phase is −90°.

4. The antenna module as claimed in claim 3, wherein each reflective unit is square.

5. The antenna module as claimed in claim 1, further comprising an EBG substrate, and the EBG substrate comprising a third surface and a fourth surface, wherein the antenna ground layer is disposed on the third surface, the EBG ground layer is disposed on the fourth surface, and the connection posts pass the EBG substrate and connect the antenna ground layer to the EBG ground layer.

6. The antenna module as claimed in claim 5, wherein the third surface faces the second surface.

7. The antenna module as claimed in claim 1, wherein each connection post is disposed in a center of the reflective unit, and the connection post is cylinder.

8. The antenna module as claimed in claim 1, wherein the second surface is connected to the antenna ground layer.

9. The antenna module as claimed in claim 1, wherein only the feed conductor is disposed on the first surface.

* * * * *